US005227010A

United States Patent [19]

Lubert et al.

[11] Patent Number: 5,227,010

[45] Date of Patent: Jul. 13, 1993

[54] REGENERATION OF FERRIC CHLORIDE ETCHANTS

[75] Inventors: John S. Lubert, Binghamton; Donald M. McGarigle, Vestal, both of N.Y.

[73] Assignee: International Business Machines Corporation, Armonk, N.Y.

[21] Appl. No.: 680,055

[22] Filed: Apr. 3, 1991

[51] Int. Cl.[5] ..... H01L 21/00

[52] U.S. Cl. ..... 156/642; 156/345

[58] Field of Search ..... 156/642, 345; 423/150

[56] References Cited

U.S. PATENT DOCUMENTS

| | | | |
|---|---|---|---|
| 2,886,420 | 5/1959 | Jones et al. | 41/42 |
| 2,908,557 | 10/1959 | Black et al. | 41/42 |
| 3,083,129 | 3/1963 | Jones et al. | 156/19 |
| 3,306,792 | 2/1967 | Thurmel et al. | 156/19 |
| 3,600,244 | 8/1971 | Wegener | 156/19 |
| 3,705,061 | 12/1972 | King | 156/19 |
| 3,788,915 | 1/1974 | Gulla | 156/19 |
| 3,855,141 | 12/1974 | Ruff | 252/79.2 |
| 3,880,685 | 4/1975 | Rehm et al. | 156/642 |
| 3,962,005 | 6/1976 | Lerner | 156/16 |
| 3,964,956 | 6/1976 | Snyder | 156/642 |
| 4,042,444 | 8/1977 | Snyder | 156/345 |
| 4,388,276 | 6/1983 | Konstantouros et al. | 156/642 |
| 4,472,236 | 9/1984 | Tanaka et al. | 156/642 |
| 4,696,717 | 9/1987 | Bissinger | 156/642 |
| 4,747,907 | 5/1988 | Acocella et al. | 156/666 |
| 4,915,776 | 4/1990 | Lee | 156/642 |
| 5,006,320 | 4/1991 | Reid et al. | 423/150 |

FOREIGN PATENT DOCUMENTS

| | | |
|---|---|---|
| 59-222583 | 12/1984 | Japan . |
| 61-106781 | 5/1986 | Japan . |
| 03-045517 | 2/1991 | Japan . |
| 03-060432 | 3/1991 | Japan . |

*Primary Examiner*—Brian E. Hearn
*Assistant Examiner*—George Goudreau
*Attorney, Agent, or Firm*—Pollock, Vande Sande & Priddy

[57] ABSTRACT

Ferric chloride etching composition is regenerated by introducing such along with oxygen gas into a static mixing zone.

14 Claims, 2 Drawing Sheets

REGENERATION OF FERRIC CHLORIDE ETCHANTS

TECHNICAL FIELD

The present invention is concerned with a process for regenerating ferric chloride etchant compositions. In particular, the present invention is concerned with the process for regenerating ferric chloride compositions that employs oxygen and avoids the use of highly reactive, potentially explosive and/or toxic chemical oxidizers employed in various prior techniques.

The present invention is concerned with a regeneration process for ferric chloride solutions that is highly efficient and can be carried out continuously and at relatively rapid rates.

BACKGROUND ART

Ferric chloride compositions are extensively used commercially such as to etch various metals including steel, copper and aluminum.

For example, the etching of steel employing ferric chloride solutions is important in the manufacture of stainless steel printbands for impact printers and for integrated circuit chip carriers.

The activity of ferric chloride compositions diminishes over a period of time of use until it reaches a point where etching with the composition is no longer satisfactory. The decay or diminishing of activity is due to the reduction of the active ferric ion to the relatively inactive ferrous ion caused by the etching reaction itself. As the etch rate decreases, the amount of metal removed per unit time likewise decreases and, therefore, the etch process through put must then suffer. However, frequent dumping of the etch bath becomes a problem since it leads to large volumes of waste products that must be treated before being converted to a waste sludge. The treatment of the waste products is a relatively costly matter; and when etching stainless steel, the waste sludge generated is classified "hazardous" due to the presence of chromium in the stainless steel and thus the sludge. The hazardous waste sludge produced requires special handling and controls for proper disposal thereby further escallating costs.

There have been various suggestions to chemically regenerate ferric chloride solutions. Such suggestions have included relatively highly reactive, potentially explosive, and/or toxic chemical oxidizers such as sodium chlorate, hydrogen peroxide, ozone and chlorine. However, these methods are not desirable in view of safety and environmental concerns. In addition, there have been certain suggestions to regenerate ferric chloride solutions by aerating or oxygenating. However, the suggested procedures tend to be relatively slow and do not adequately keep up with the rate of formation of ferrous ion during high volume etching procedures.

More recently, there have been suggestions to employ electrolytic regeneration of certain ferric chloride compositions. However, the processes suggested are not entirely satisfactory from a standpoint of efficiency and safeness. Moreover, such processes are relatively expensive and costly to operate, and many of the suggested processes for electrolytic regeneration result in the generation of a significant amount of chlorine gas at the anode.

SUMMARY OF INVENTION

The present invention provides a process for regenerating ferric chloride solution that is highly efficient, safe to carry out, relatively fast, and does not require highly reactive, potentially explosive and/or toxic chemical oxidizers and does not require electro-chemical means.

The regeneration process of the present invention is compatible with high volume manufacturing processes since the process of the present invention can be carried out at relatively high rates. In fact, the process of the present invention can be carried out at a rate that can keep pace with the formation of ferrous ions, and therefor can be used as a continuous process. Moreover, in view of the extremely high efficiency achieved by the present invention, the process is quite compatible for those industrial processes where high quality with close tolerance processing must be observed.

More particularly, the process of the present invention comprises introducing the ferric chloride etching composition into a static mixing zone, and introducing oxygen gas into the static mixing zone in concurrent flow with the ferric chloride etching composition. Contact between the oxygen gas and the ferric chloride composition in the static mixing zone is maintained for at least about 2 seconds per cycle to thereby regenerate the ferric chloride etching composition. The process of the present invention can be employed as an in-line procedure.

BEST AND VARIOUS MODES FOR CARRYING OUT INVENTION

Figure 1:
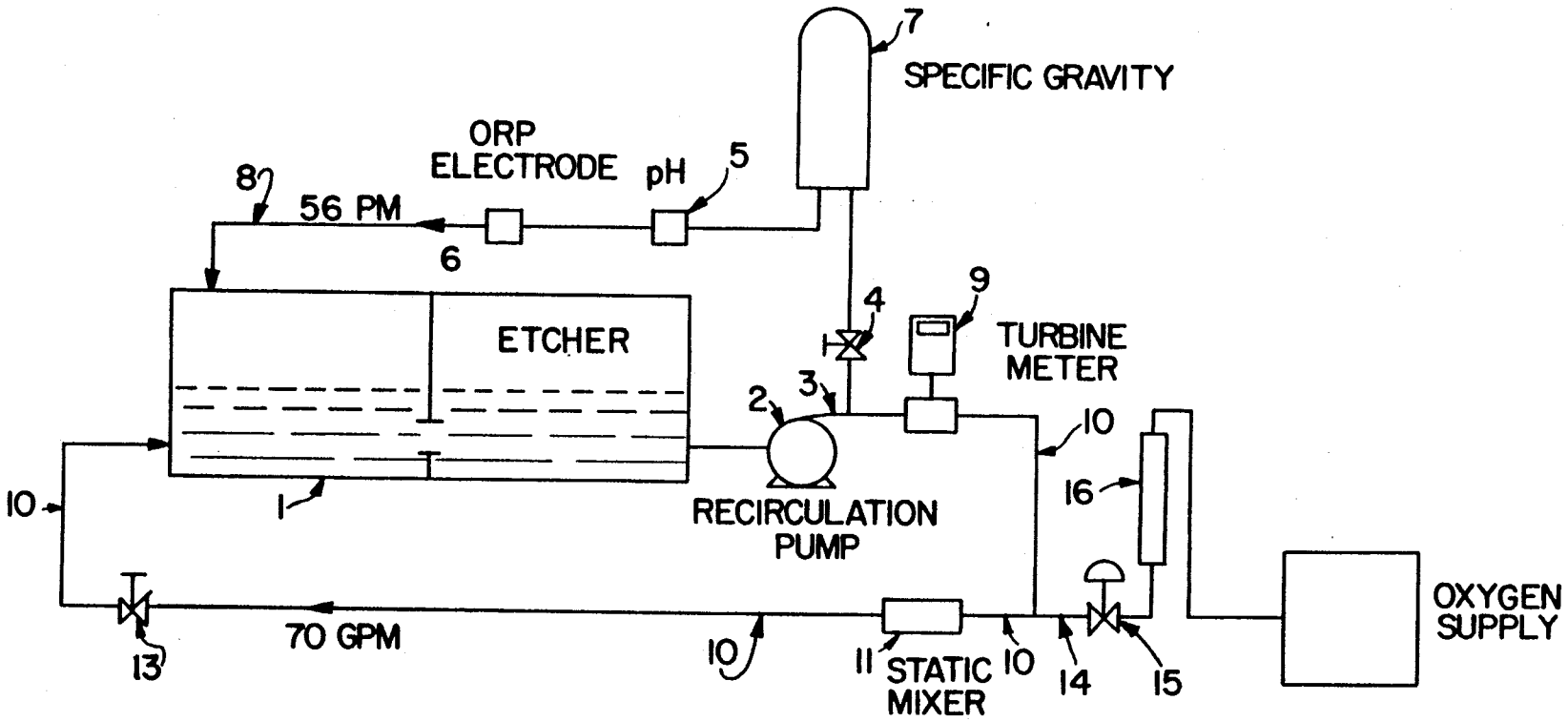
FIG. 1 is a schematic diagram of the equipment arrangement suitable for carrying out the process of the present invention.

FIG. 1 illustrates an on-line process for regenerating ferric chloride etchant that can be operated during the etching process and is capable of maintaining the etch rate without the need for the addition of fresh etchant. However, it is understood that an off-line or batch system could also be employed using a similar piping arrangement and process conditions with a bulk holding tank. However, according to preferred aspects of the present invention, the process is practiced as an on-line process. In particular, the etchant is removed from the etcher sump 1 via recirculation pump 2 via conduit 3. A small test sample can be bled off of conduit 3 by opening valve 4 to determine such parameters as the pH, the oxygen-reduction potential (ORP) and the specific gravity of the composition employing a pH measuring device 5, oxidation-reduction potential measuring device 6 and a specific gravity measuring device 7. Such devices are well known in the prior art and need not be described here in any detail. For example, for pH; a Foxboro Model 870PH transmitter (range −2 to +3 pH) along with a Foxboro Model 871PH sensor can be used. For ORP; a Foxboro Model 870PH transmitter (range +300 to +800 mV) along with a Foxboro Model 871 PH ORP sensor can be used. For specific gravity; an Automation Products Dynatrol (range 1.0 to 1.5 S.G.) can be used. The sample solution is then recirculated back to the etcher sump 1 via conduit 8 which typically is a one-inch polyvinylidene chloride (PVDC) pipe. A typical flow rate through this sampling loop is about 3 to about 7 gallons per minute and preferably about 4 to about 5 gallons per minute, an example of which is about 5 gallons per minute. The desired pH of the etching solution to be effective is about −1.0 to about 0.0, the oxidation-reduction potential is about 550 to about 570 millivolts (mv) and the specific gravity is about 1.355±.05.

The ferric chloride etching composition to be regenerated is conveyed at a rate of about 50 to about 80 gallons per minute, preferably about 65 to about 70 gallons per minute, typical of which is about 65 gallons per minute. The flow rate of the spent ferric chloride etching composition can be measured by turbine meter 9. The ferric chloride etching composition is conveyed via conduit 10 which typically is a pipe such as polyvinylidene chloride (PVDC) of about two inches in diameter. The ferric chloride etchant composition is heated to a temperature of about 53° C. to about 55° C. typical of which is about 53.5° C. The composition is conveyed via conduit 10 to the static mixers 11.

In the event, the composition does not require regeneration as determined by the results from the pH, oxidation-reduction potential and specific gravity tests, the composition is just recycled back to the etcher sump. The ORP controller can turn on and/or off the supply of oxygen gas to the static mixers, thereby controlling the amount of or degree of regeneration. Typically the ORP is controlled to some set point or fixed number thereby stabilizing the chemical etch rate. Static mixing units are commercially available from Koch Engineering Co., Inc.

Figure 2:
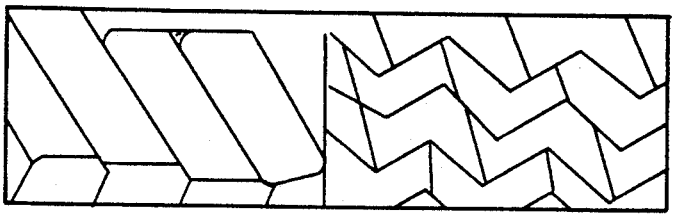
FIG. 2 is a schematic cross section diagram of a static mixer suitable in the process of the present invention.
Figure 3:
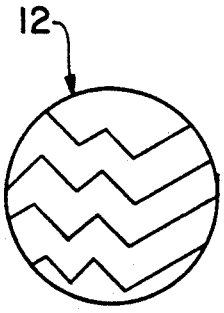
FIG. 3 is an end view of the static mixer illustrated in FIG. 2.

Static mixers 11 include baffles or stationery rigid elements 12 as illustrated in FIGS. 2 and 3. The baffles are located lengthwise in a pipe-like member. Back pressure is maintained on the static mixers via throttling valve 13 located downstream of static mixers 11. The back pressure created is normally about 8 to about 12 and preferably about 9.5 to about 10.5 psig. Oxygen gas is fed into the system via conduit 14 at a flow rate of about 4 to about 12 SCFM, typical of which is about 7.5 standard cubic feet per minute. The flow rate is adjusted by valve 21 and monitored by meter 16. The oxygen is fed into the system just upstream of the static mixers and is delivered into the vicinity of the center of the recirculating conduit 10. The oxygen gas flows concurrently with the spent ferric chloride composition. The pressure of the oxygen introduced is maintained at a level above that of the circulating ferric chloride etchant and normally at about 2 to about 10 psig above that of the circulating ferric chloride etching composition. The pressure at which the oxygen is introduced is normally at about 35 to about 55 psig typical of which is about 44 psig. The contact time in the static mixers between the oxygen gas and the ferric chloride etchant is at least about 2 seconds, preferably about 2 to about 4 seconds, typical of which being about 2.5 seconds.

During the process, essentially all of the oxygen gas introduced is consumed in the reaction, converting the ferrous +2 ions back to ferric +3 ions in the regeneration reaction. Moreover, very few gas bubbles are returned into the etcher sump. This is contrasted with the use of air as a source of oxygen in that nitrogen bubbles present in the return stream create a heavy foam layer. Use of the oxygen gas pursuant to the present invention under the judiciously selected control conditions eliminate foaming since extremely small amounts of unreacted gas is returned to the circulating etchant. The resultant regenerated etchant composition has etching characteristics that are not dissimilar to those of the original etching composition.

As apparent from the above description, the process of the present invention can be practiced as an on-line process that is operated during the etching process itself and is capable of maintaining the etch rate without the necessity of adding additional fresh etchant.

In addition, in order to adjust the pH when necessary, chloride ions such as in the form of HC1, are added to the etchant in sump 1.

The preferred compositions regenerated, according to the present invention, have an original composition before etching of about 175 to about 225 grams/liter of ferric ion, and 0 to about 10 grams/liter of ferrous ion. Also, such compositions typically contain about 0.1 to 3 molar (about 5 to 100 grams/liter) HC1. The etchant in the operation system of the present invention is maintained at a set point of approximately 550 to 565 mV. through the continuous regeneration via oxygen injection into the operation system. This correlates to a ferric ion concentration of 125 to about 150 grams/liter and a ferrous ion concentration of 50 to about 80 grams/liter.

The following non-limiting example is presented to further illustrate the present invention:

EXAMPLE 1

This example demonstrates the ability of the present invention to maintain the ferric ion chemistry constant through the disclosed in situ regeneration process of the present invention.

A ferric chloride etchant composition containing about 135 grams/liter of ferric ions and about 60 grams/liter of ferrous ions with an ORP of approximately 560 mV is conveyed via a recirculation pump at a rate of about 65 gallons per minute through two inch polyvinylidene chloride piping, the temperature of the composition is raised to about 54.5° C. Concurrently, a sidestream is removed at a rate of about 5 gallons per minute and tested for pH, oxidation-reduction potential, and specific gravity, which values as measured are as follows: pH=−0.5, Oxidation-reduction potential =560 mV and specific gravity =1.350. The sample stream is then recirculated back to the etcher sump. The etchant composition is then conveyed to two static mixers (commercially available under the trade designation SMV from Koch Engineering Co., Inc.) along with oxygen gas at a rate of about 7 standard cubic feet per minute at a pressure of about 45 pounds per square inch. The back pressure on the etchant composition is about 10 pounds per square inch. The contact time between the oxygen gas and ferric chloride etchant is about 2.5 seconds in the mixing zone. The regenerated composition obtained from the static mixers has a pH of about −0.5, an oxygen-reduction potential of about 560 mV, a specific gravity of about 1.350 and contains about 135 grams per liter of ferrous ions and about 60 grams per liter of ferric ions.

At this same time, etching of the stainless steel material at a rate of approximately 1 mil per minute is maintained through injection of oxygen as at a rate of 7 SCFM and a pressure of 45 psig in the regeneration recirculation piping. This equates to approximately 70 grams per minute of stainless steel removed or dissolved by the etchant. During the time of active etching, no addition of ferric chloride is required. Thus simulataneous etching and regeneration result in no decrease in etchant strength as indicated by ORP or ferric and ferrous ion concentration measurements. The regeneration rate achieved has been determined via experimental tests to be approximately 4.92 mV per hour under the following test conditions:

test duration=4.0 hours
etchant pH=−0.25±0.1
etchant specific gravity=1.350±.005
starting etchant ORP=551.8 mV
ending etchant ORP=571.5 mV
oxygen feed rate=5.2 SCFM
oxygen feed pressure=40–41 psig
etchant recirculation flow rate through piping=60 GPM
length of static mixer=15 inches
length of mixing zone=15 feet This regeneration rate can be altered via changes in the above conditions.

What is claimed is:

1. A method for regenerating a ferric chloride etching composition which comprises introducing spent ferric chloride etching composition into a static mixing zone and introducing oxygen gas at a flow rate of about 4 to about 12 SCFM into said static mixing zone in concurrent flow with said ferric chloride etching composition; maintaining contact between the oxygen gas and said ferric chloride composition in said zone for at least about 2 seconds to thereby regenerate the ferric chloride etching compostion and wherein the back pressure on the ferric chloride etching composition in the static mixing zone is about 8 to about 12 psig, and the oxygen is fed at a pressure about 2 to about 10 psig above that of the etching composition.

2. The process of claim 1 wherein the contact between the oxygen gas and the ferric chloride composition in the static mixing zone is about 2 to about 4 seconds.

3. The method of claim 1 wherein the ferric chloride etching composition that is regenerated has a pH of about −0.5.

4. The method of claim 1 wherein the oxygen is fed at a pressure of about 35 to about 55 psig.

5. The method of claim 1 wherein the flow rate of the spent ferric chloride etching composition into the mixing zone is about 50 to about 80 gallons per minute.

6. A method for regenerating a ferric chloride etching composition which consists essentially of introducing spent ferric chloride etching composition into a static mixing zone and introducing a gas consisting essentially of oxygen at a flow rate of about 4 to about 12 SCFM into said static mixing zone in concurrent flow with said ferric chloride etching composition; maintaining contact between the oxygen and said ferric chloride composition in said zone for at least about 2 seconds to thereby regenerate the ferric chloride etching composition, and wherein the back pressure on the ferric chloride etching composition in the static mixing zone is about 8 to about 12 psig, and the oxygen is fed at a pressure about 2 to about 10 psig above that of the etching composition.

7. The method of claim 1 wherein the regeneration is carried out continously.

8. The method of claim 7 wherein the regeneration is carried on-line during an etching process.

9. The method of claim 6 wherein the ferric chloride etching composition that is regenerated as a pH of about −0.5.

10. The method of claim 6 wherein the contact between the oxygen and the ferric chloride composition in the static mixing zone is about 2 to about 4 seconds.

11. The method of claim 6 wherein the regeneration is carried out continuously.

12. The method of claim 6 wherein the oxygen is fed at a pressure of about 35 to about 55 psig.

13. The method of claim 6 wherein the flow rate of the spent ferric chloride etching composition into the mixing zone is about 50 to about 80 gallons per minute.

14. The method of claim 11 wherein the regeneration is carried on-line during an etching process. 7. The method of claim 1 wherein the regeneration is carried out continuously. 8. The method of claim 7 wherein the regeneration is carried on-line during an etching process.

* * * * *